United States Patent [19]

Takada et al.

[11] 4,254,754

[45] Mar. 10, 1981

[54] AIR FUEL RATIO CONTROLLER

[75] Inventors: Shigetaka Takada; Masayuki Okamura, both of Ohbu; Kazumichi Naruse, Aichi; Yukihiro Watanabe, Nagoya, all of Japan

[73] Assignee: Aisan Industry Co., Ltd., Aichi, Japan

[21] Appl. No.: 41,229

[22] Filed: May 21, 1979

[30] Foreign Application Priority Data

May 26, 1978 [JP] Japan ..... 53/72138

[51] Int. Cl.[3] ..... F02B 33/00

[52] U.S. Cl. ..... 123/437; 137/625.48

[58] Field of Search ..... 123/119 EC; 60/276, 60/285; 137/625.48, 605

[56] References Cited

U.S. PATENT DOCUMENTS

| | | | |
|---|---|---|---|
| 4,132,199 | 6/1979 | Kuruiwa et al. | 60/276 |
| 4,181,108 | 6/1980 | Bellicardi | 60/276 |

*Primary Examiner*—Charles J. Myhre
*Assistant Examiner*—R. A. Nelli
*Attorney, Agent, or Firm*—Martin A. Farber

[57] ABSTRACT

An air-fuel ratio controller for use in an internal combustion engine, of a type having an exhaust gas sensor disposed in the exhaust passage, a control circuit and a solenoid valve having a valve seat in which passages open leading to the air bleeds of the slow and main systems of the carburetor, the controller being adapted to actuate a valve of the solenoid valve, in accordance with a signal derived from the exhaust gas sensor, into and out of contact with the valve seat, so as to simultaneously control the flow rates of bleed air in the air bleeds of the slow and main systems. A recess is formed in the cooperating surface of the valve seat or the valve, at a position between the openings of the passages in the valve seat. This recess communicates with a chamber which in turn communicates with the air inlet. Unfavorable mutual direct communication of the passages with each other is avoided, even when a slight gap is formed between the valve seat and the valve seated on the latter due to inclination of the valve seat or the like reason, because both passages communicate with the chamber through the recess.

9 Claims, 3 Drawing Figures

AIR FUEL RATIO CONTROLLER

BACKGROUND OF THE INVENTION

The present invention relates to an air-fuel ratio controller having a feedback system in which the air-fuel ratio of the mixture formed in the carburetor is controlled in accordance with a signal derived from an exhaust gas sensor and, more particularly, to an improvement in an actuator for use in the feedback system and adapted for effecting the control of the air-fuel ratio.

There have been proposed and actually used various types of air-fuel ratio controllers of the kind described. In a typical conventional air-fuel ratio controller, as will be explained later in more detail, a passage communicating with the air bleed of the main system and a passage communicating with the air bleed of the slow system of the carburetor are opened in a common valve seat which is flat and adapted to make a surface contact with a cooperating flat valve. Therefore, if the valve is mounted at a slight inclination or if the valve seat is not sufficiently finished, the passages leading to respective air bleeds often communicate with each other, even when the valve is seated on the valve seat. In such a case, since the vacuum in the slow system is greater than the vacuum established in the main system, the fuel is inconveniently induced from the main system into the slow system.

SUMMARY OF THE INVENTION

It is therefore an object of the invention to overcome the above described problem of the prior art by providing an improved air-fuel ratio controller.

To this end, according to the invention, there is provided an air-fuel ratio controller of a type having an exhaust gas sensor and a controlling circuit in which the flow rates of the air bleeds of the slow and main systems of a carburetor are simultaneously controlled by means of one ON-OFF type electromagnetic valve, characterized by a recess formed in the valve or the valve seat of the solenoid valve at a portion between the openings of the passages which leads to respective air bleeds of the slow and main systems, the recess being adapted to prevent the openings of both passages from communicating with each other, and communicating with a chamber which in turn communicates with the inlet passage for air.

The above and other objects, as well as advantageous features of the invention will become more clear from the following description of the preferred embodiments taken in conjunction with the accompanying drawings.

DESCRIPTION OF THE PREFERRED EMBODIMENTS

Before turning to the description of the preferred embodiments, an explanation will be made as to the drawback of the conventional air-fuel ratio controller, with specific reference to FIG. 1, so that the advantage of the invention may be more readily and clearly understood.

Figure 1:
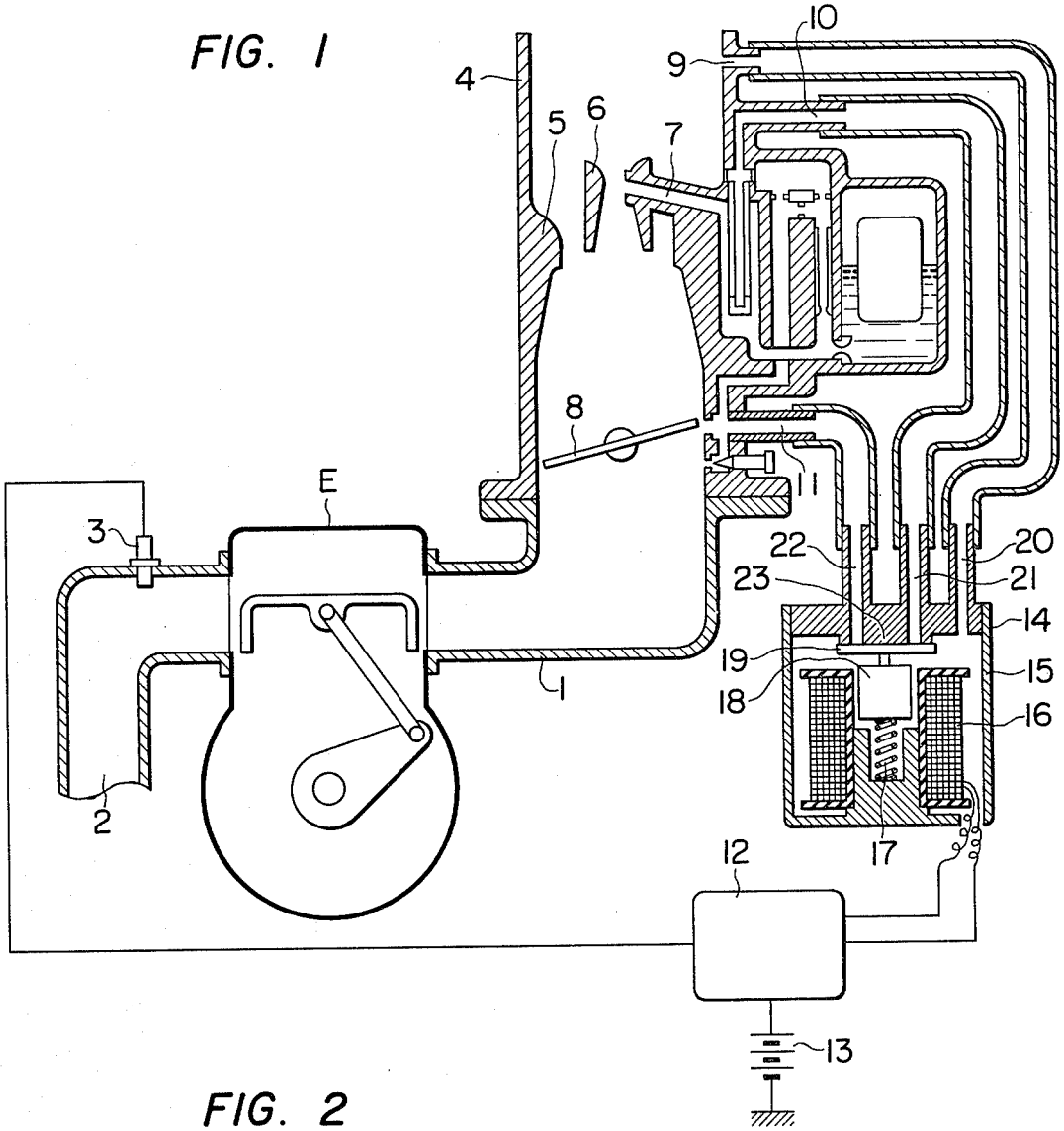
FIG. 1 is a sectional view of a conventional air-fuel ratio controller.

Referring to FIG. 1 showing a conventional air-fuel ratio controller, an intake manifold 1 and an exhaust manifold 2 are attached to an internal combustion engine E. An exhaust gas sensor 3 is disposed in the exhaust manifold 2, while a carburetor body 4 is attached to the upstream side of the intake manifold 1. The carburetor has a large venturi 5, a small venturi 6, a nozzle port 7, a throttle valve 8, an air inlet 9 for air bleeds, an air bleed passage 10 for the main system, and an air bleed passage 11 for the slow system. A control circuit 12 is provided while batteries 12 constitute a power supply. An actuator 14 for actuating the valve for controlling the air supply to the air bleeds includes a casing 15 accommodating a coil bobbin 16 which is adapted to electromagnetically drive an armature 18. A spring 17 is adapted to bias the armature 18 towards a flat valve seat 23 and a valve 19 is attached to the armature 18. An air passage 20 leading from the air inlet 9 opens in the casing 15. Passages 21 and 22 respectively, conduct the air bleed of the main system and the air bleed of the slow system. These passages 21, 22 open in the flat valve seat 23 which is adapted to cooperate with the valve 19.

In the conventional air-fuel ratio controller having the described construction, since the air-tightness depends upon the surface contact of the flat valve seat 23 and the flat valve 19 with each other, the passages 21 and 22 inconveniently communicate with each other, even when the valve 19 is seated on the cooperating valve seat 23, if the valve 19 is mounted at a slight inclination or if the valve seat 23 has been finished in a poor manner. In such a case, since the level of the vacuum in the passage 22 of the slow system is generally high, the fuel is inconveniently drawn from the passage 10 of the main system into the passage 11 of the slow system.

This problem is fairly overcome by the air-fuel ratio controller of the invention, as will be understood from the description of the preferred embodiment of the invention.

Figure 2:
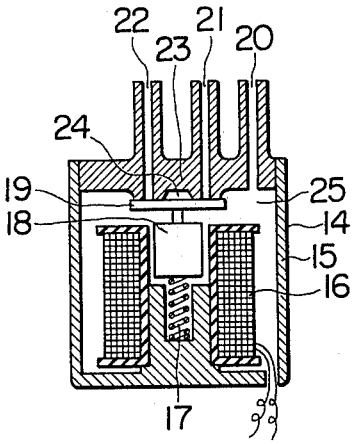
FIG. 2 is a sectional view of an essential part of an air-fuel controller constructed in accordance with an embodiment of the invention.

Referring now to FIG. 2 showing in section an essential part of an embodiment of the invention, the passages 22, 21 leading to the air bleeds of the slow and the main systems open in the valve seat 23, as in the conventional air-fuel controller. However, according to the invention, a recess 24 is formed in the surface of the valve seat 23, at a portion of the latter between the openings of both passages 21, 22. The recess 24 communicates with the chamber 25, through a passage of a cross-section sufficiently larger than that of the opening of the passage 21, 22.

When the coil of the bobbin 16 is not energized, the spring 17 biases the armature 18 and, accordingly, the valve 19, so as to press the latter against the valve seat 23. As the coil of the bobbin 16 is energized, a magnetic force is generated to drive the armature 18 downwardly overcoming the force of the spring 17, so that the valve 19 is moved away from the valve seat 23, so as to allow the passages 21, 22 to communicate with the chamber 25. Consequently, the air is drawn into the passages 21, 22 from the inlet passage 20, through the gap between the valve 19 and the valve seat 23, so as to control the air bleed flow rates in the slow and main systems. The ratio of the opening period to the closing period of the On-Off type electromagnetic or solenoid valve, i.e. the so-called duty ratio, is controlled in accordance with the signal derived from the exhaust gas sensor 3, so that the flow rates of the air bleeds are adjusted to provide the desired air-fuel ratio of the mixture formed in the carburetor.

A slight gap may be formed between the valve 19 and the valve seat 23, due to an inclination of the valve 19 or the seat 23, or the insufficient finishing or flatness of the valve seat, even when the valve 19 is seated on the valve seat 23. However, even when such a slight gap is formed, the mutual communication of the passages 21 and 22 is avoided, because the passage 21 or the passage 22 here communicates with the chamber 25, due to the presence of the recess 24 in accordance with the present invention.

Figure 3:
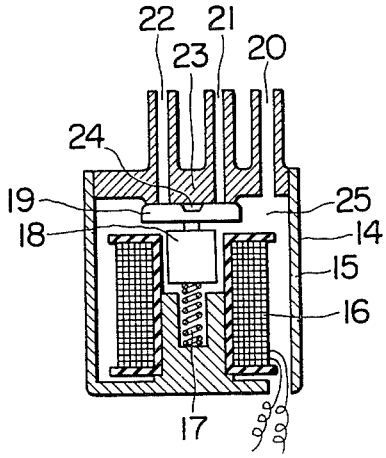
FIG. 3 is a sectional view of an essential part of an air-fuel ratio controller constructed in accordance with another embodiment of the invention.

FIG. 3 shows another embodiment of the invention, in which the recess 24 is formed in the surface of the valve 19, instead of in the valve seat 23. It will be clear to those of ordinary skill in the art that this second embodiment functions in the same manner as the first embodiment as shown in FIG. 2.

Thus, in the air-fuel ratio controller of the invention, the passages 21, 22 communicate with the chamber 25, even when a slight gap is formed between the valve 19 and the valve seat 23 due to inclination, insufficient flatness and bad finishing of the valve or the valve seat.

Since the chamber 25 is ample enough and the pressure therein is maintained at the same level as that of the air at the inlet of the carburetor, i.e. substantially at the atmospheric pressure, the pressure in the passage 21 is kept at the same level as the pressure at the carburetor inlet, due to the communication of the passage 21 with the chamber 25 through the recess 25. Also, the pressure in the passage 22 is kept at the same level as the pressure at the carburetor inlet, due to the communication of the passage 22 with the chamber 25 through the recess 24.

Thus, the mutual direct communication of the passages 21, 22 through the gap between the valve 19 and the valve seat 23 is prevented, and the aforementioned unfavourable drawing of the fuel from the passage 10 of the main air bleed into the passage 11 of the slow air bleed is fairly avoided.

It is remarkable that this practical advantage is brought about by simply forming a recess 24 in the valve seat 23 or the valve 19.

What is claimed is:

1. An air-fuel ratio controller for an internal combustion engine having a carburetor with air bleeds of a slow system and a main system and air passages respectively connected with said air bleeds, comprising an exhaust gas sensor, a single solenoid valve having a valve member, a control circuit means operatively connected between said sensor and said solenoid valve, said solenoid valve having a valve seat, the air passages which are connected to said air bleeds of the slow system and of the main system define openings which open in said valve seat on a common continuous plane, said valve seat being on said common continuous plane, said valve member and said valve seat forming cooperative members mounted displaceably relative to each other, said control circuit means for actuating, in accordance with a signal derived from said exhaust gas sensor, said valve member of said solenoid valve into contact and out of contact, respectively, with said valve seat so as to simultaneously control flow rates of bleed air in said air bleeds of said slow system and said main system, said cooperative members each defining a cooperating surface, respectively, said cooperating surface of one of said cooperative members being formed with a recess constituting means for preventing mutual direct communication of said air passages with each other, said recess being formed in said last-mentioned surface between said openings of said air passages in said valve seat, and chamber means for communicating said recess with an air inlet.

2. The controller as set forth in claim 1, wherein said recess is formed in said valve seat at a portion thereof between said openings.

3. The controller as set forth in claim 1, wherein said recess is formed in said valve member at a portion thereof between said openings.

4. The controller as set forth in claim 1, wherein said solenoid valve is formed with a casing defining said chamber means and containing said cooperative members therein.

5. The controller as set forth in claim 1, further comprising another air passage communicates said chamber means with said air inlet at an inlet to the carburetor substantially at atmospheric pressure.

6. The controller as set forth in claim 1, wherein said air bleed of said slow system is in said carburetor downstream of said air inlet, and said air bleed of said main system is in said carburetor between said air inlet and said air bleed of said slow system.

7. The controller as set forth in claim 1, wherein said air bleeds of said main system and of said slow system are at different vacuum pressures, and said air inlet is at a higher pressure than both said different vacuum pressures.

8. The controller as set forth in claim 1, wherein said recess communicates with said chamber means via a passage cross-section larger than that of said openings of said air passages.

9. The controller as set forth in claim 1, wherein said solenoid valve is an ON-OFF type electromagnetic valve means for controlling the flow rates of the air bleeds in said air passages in accordance with the signal derived from said exhaust gas sensor via said control circuit means by the ratio of an opening period to a closing period of said valve member relative to said valve seat.

* * * * *